United States Patent [19]

Seigler et al.

[11] 3,982,405

[45] Sept. 28, 1976

[54] HAZARDOUS DUTY ROOM AIR CONDITIONER

[76] Inventors: Jack D. Seigler, 546 Beryl, San Antonio, Tex. 78213; Gerald L. Rodgers, 14211 Turtle Rock, San Antonio, Tex. 78232

[22] Filed: July 23, 1975

[21] Appl. No.: 598,334

Related U.S. Application Data

[62] Division of Ser. No. 467,146, May 6, 1974, Pat. No. 3,911,693.

[52] U.S. Cl. ..... 62/181; 307/252 B

[51] Int. Cl.[2] ..... F25D 17/00; F25B 49/00

[58] Field of Search ..... 62/229, 181, 207; 307/252 B, 247 A; 236/78; 219/501

[56] References Cited

UNITED STATES PATENTS

| | | | |
|---|---|---|---|
| 3,211,214 | 10/1965 | Chambers | 219/499 X |
| 3,514,967 | 6/1970 | Vander Molen | 62/181 X |
| 3,593,112 | 7/1971 | Coats | 307/252 B |
| 3,781,604 | 12/1973 | Scarpino | 307/252 B |

*Primary Examiner*—William E. Wayner

*Attorney, Agent, or Firm*—Lane, Aitken, Dunner & Ziems

[57] ABSTRACT

An air conditioner suitable for use in a hazardous environment. The air conditioner, which may be of the conventional window type, is modified in such a manner that sparks are either eliminated, suppressed or contained to the extent that there is no danger of igniting an atmosphere that may contain an excess of dangerous particles. Any switching required in the electrical circuit is done by solid state devices, or with open contacts that carry such low power that sparking cannot occur, with the main load of the air conditioner being carried by the solid state device. The air conditioner is designed to withstand hostile elements such as salt spray from the ocean without excessive corrosion. A bypass valve is included to prevent frost collection on the evaporator coils if the air conditioner is unattended for long periods of time.

2 Claims, 13 Drawing Figures

HAZARDOUS DUTY ROOM AIR CONDITIONER

This is a division, of application Ser. No. 467,146 filed May 6, 1974, now U.S. Pat. No. 3,911,693.

BACKGROUND OF THE INVENTION

The present invention relates to air conditioners; and, more particularly, to air conditioners for use in a hazardous or hostile environment.

The present invention was developed in conjunction with offshore drilling activities, wherein it was desirable to keep the equipment room at a constant temperature over long periods of time when the oil drilling platform was unattended. Because of the gas that could escape during the drilling operations or while pumping and storing oil, an economical air conditioner that could be left alone over these extended periods of time and not ignite an atmosphere that may contain an excess of explosive gas became imperative. Also, the air conditioner that was used must be able to withstand the hostile elements of the salt spray atmosphere over these extended periods of operation. The atmosphere outside the air conditioned room could not be co-mingled with the cooled air inside the air conditioned room for fear of introducing a possible explosive gas. With these requirements in mind, the present air conditioner was developed.

Although it was developed initially in conjunction with oil drilling operations on offshore platforms, the present invention would have a number of other uses, such as mining operations, where a large amount of explosive dust particles and explosive material may be in the atmosphere.

BRIEF DESCRIPTION OF THE PRIOR ART

Prior to the present invention conventional window air conditioning units were used in hostile environments under conditions that may be extremely hazardous. These conventional units had no means of arc suppression to prevent the normal operation of the air conditioners from igniting the atmosphere if it contained an explosive gas. The spark from a thermostat switching the compressor and/or fan motor could be sufficient to set off the explosive gas in the atmosphere, thereby causing an untold amount of damage. Most of the conventional units, of an economic price, do not have a means for preventing frost collection on the evaporator coils. Hence, if no one attended the air conditioner over long periods of operation, the air conditioner could freeze up and allow the room temperature to increase drastically. This increase in room temperature could destroy or damage much of the equipment contained therein. Also, the conventional air conditioning units do not have a means to withstand hostile elements, such as salt water spray, over long periods of time.

To meet the safety regulations that were required in offshore drilling operations, a very expensive air conditioning unit had to be purchased. However, with the hostile elements such as the salt water spray, the expensive air conditioning unit may last only a short period of time. One process that was used to some extent was to buy conventional air conditioners and to make extensive modifications upon these air conditioners to meet the environmental requirements. However, this was a very expensive, time consuming process, wherein many of the characteristics of the air conditioning unit may be altered, plus the unit is still of questionable reliability after the modifications are complete. Needless to say, the salt water elements would soon corrode away the conventional air conditioners. When left alone over a long period of time, a conventional air conditioner may accumulate frost on the evaporator coils and soon freeze up.

SUMMARY OF THE INVENTION

Therefore, it is an object of the present invention to provide an environmentally protected air conditioner for use in hostile environments.

It is another object of the present invention to provide an air conditioner that will prevent freeze-up during long periods of unattended use.

It is still another object of the present invention to provide an air conditioner that will prevent the co-mingling of the conditioned air and the outside atmosphere which may contain dangerous elements.

It is a further object of the present invention to provide an air conditioner that will not ignite an explosive atmosphere during normal operation.

It is a still further object of the present invention to provide an air conditioner with environmentally sealed switches, solid state switching devices, or switches that switch low currents to prevent explosion within an atmosphere that could contain a dangerous gas.

It is even another object of the present invention to provide an air conditioner having compressor and fan motors with internally sealed overload switches to prevent heat or sparks if the motor is in a locked rotor condition or if there is a short circuit.

It is still another object of the present invention to provide an air conditioner with a solid state switching device for controlling the operation of the fan and compressor motors wherein the main load of the air conditioner is carried by the solid state switching device.

DESCRIPTION OF THE PREFERRED EMBODIMENT

Figure 1:
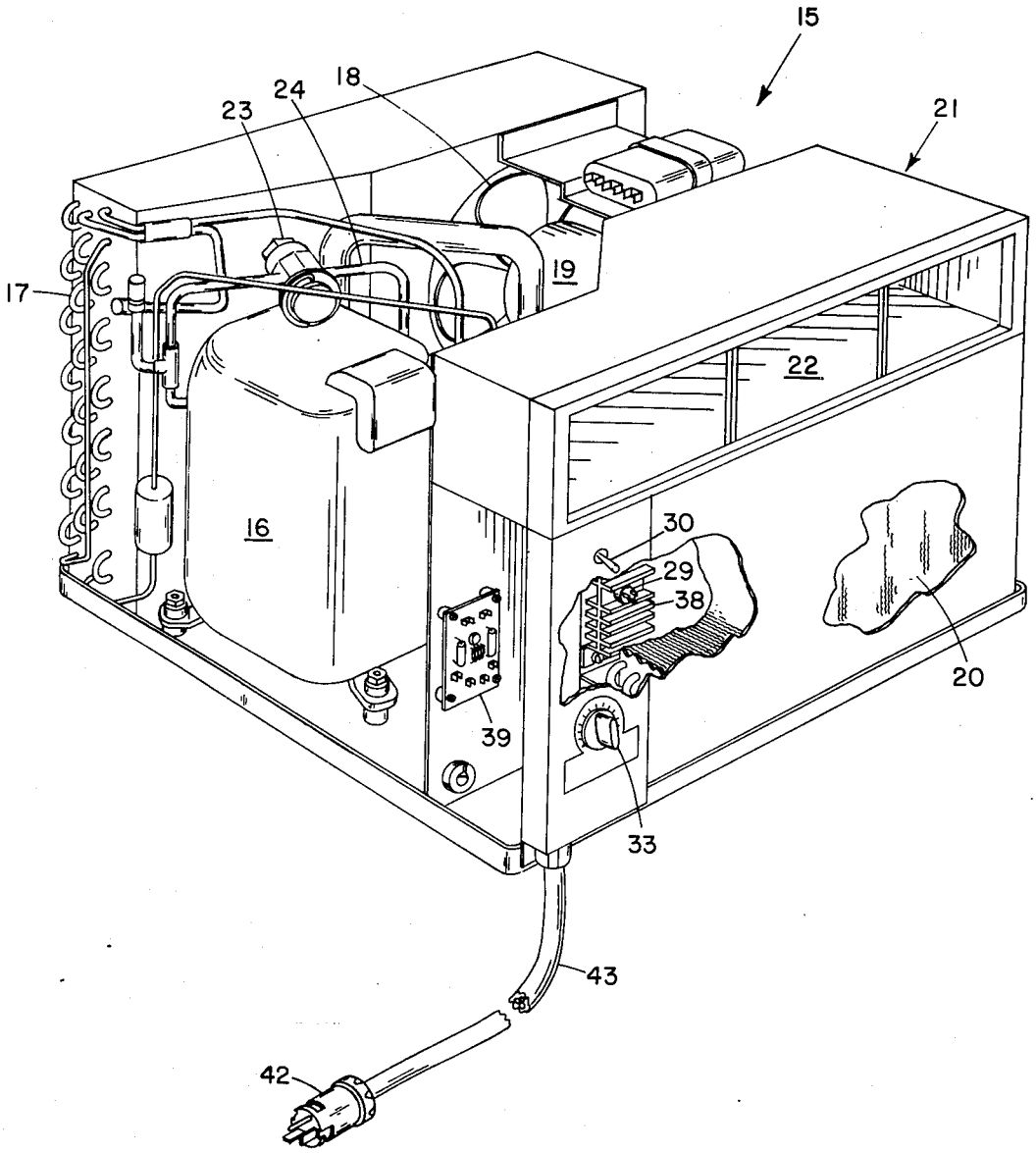
FIG. 1 is a pictorial view of the air conditioner for use in hostile environments with the cover removed and having appropriate partial sections.
Figure 2:
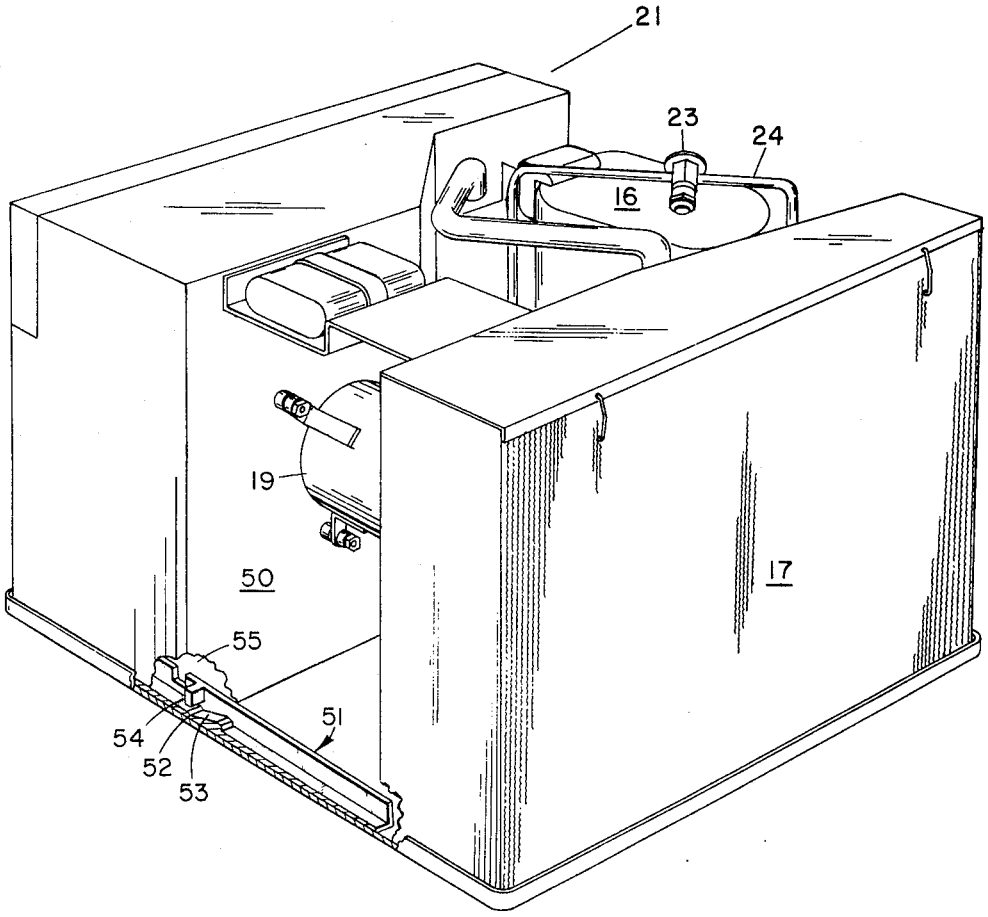
FIG. 2 is another pictorial view of the air conditioner shown in FIG. 1 taken from the rear thereof.

Referring to FIGS. 1 and 2 of the drawings, there is shown pictorial views of a window air conditioner embodying the present invention. First, a general description of the operation of window type room air conditioners will be discussed before going into the improvements of the present invention.

The Hazardous Duty Air Conditioner is represented generally by the reference numeral 15 and has a compressor 16 for pressurizing a refrigerant such as diclorodflouromethane $Cl_2CF_2$ (commonly called Freon) for use in the cooling system. For the purposes of this invention, assume that Freon is the refrigerant used. After the Freon has been pressurized to a high pressure vapor, it flows from the compressor 16 to the condenser 17. While in the condensor 17, the high pressure vapor is cooled by means of a fan 18 blowing air over the condenser 17 and out the rear of the Hazardous Duty Air Conditioner 15. The fan 18 is driven by motor 19 in a manner similar to previously designed and manufactured air conditioner. The cooling of the high pressure vapor in the condenser 17 transforms the vapor into a liquid state. Thereafter, the liquid freon flows through a filter drier and then to the evaporator 20 by means of a capillary tube. The compressor 16, which is attached to the opposite end of the evaporator 20, creates a suction pressure on the evaporator. This suction pressure on the evaporator 20 allows the liquid to expand very rapidly within the evaporator 20. This rapid expansion of the liquid freon within the evaporator 20 causes the liquid to change back to a low pressure vapor and at the same time absorb heat from the nearby surroundings.

By the use of a fan blowing over the evaporator 20, cool air is generated for the air conditioned room. On the opposite end of motor 19 from fan 18 is connected a blower (not visible) contained within the front portion 21 of the Hazardous Duty Air Conditioner 15. This blower, which shall be called the evaporator blower, sucks air in over evaporator coils 20 from the front of the air conditioning unit and blows the cooled air out of ducts 22 into the air conditioned room. Motor 19 may consist of one motor or may be two separate motors that are attached together with one motor driving the condenser fan 18 and the other motor driving the evaporator blower.

The general operation of a conventional air conditioner has been described with the exception of the control circuit for supplying power to the fans and compressors which will be described in conjunction with the present invention. For a better understanding of the air conditioners just described, "Modern Refrigeration and Air Conditioning" by Althouse/Turnquist/-Bracciano published by the Goodheart-Willcox Company Inc. in Homewood, Illinois, in 1968, contains a good discussion, with a portion of this discussion being on pages 108–109.

Figure 3:
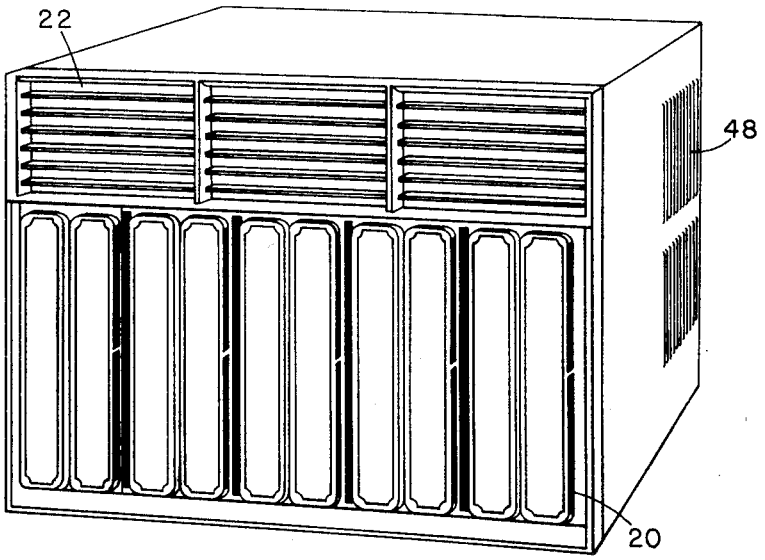
FIG. 3 is a pictorial view of the air conditioner mounted in the cover.

In the present invention, because the air conditioner may be left for long periods of time in environments that may have explosive gas vapors, it is very important that the air within the air conditioned room not be contaminated by the atmosphere that provides the cooling of the condenser coil 17. Therefore, the front portion 21 is a sealed unit with the only air entering the front portion 21 being the air that flows over evaporator coils 20 from the air conditioned room and out ducts 22. None of the air that flows in the side vents 48 (see FIG. 3) of Hazardous Duty Air Conditioner 15 and over the condenser coils by means of fan 18 can mix with the room atmosphere as is common in other air conditioners. The seal between outside and inside atmosphere is not absolute, but the amount of mixing under the worst of conditions would be very nominal. Evaporator coil 20 has a drain pan and tubing for connecting the drain pan to the rear of the air conditioner, however, water within the tubing prevents outside atmosphere from entering the air conditioned room. In the present invention the tubing has been formed by a trough 51 normally having a cover (not shown in the present invention for the purposes of illustration) wherein the trough 51 forms an airtight seal with dividing wall 50. The trough 51 which extends through the lower corner of the dividing wall 50 has a V-pocket 52 to which all the collective water from the evaporator coil 20 will flow by normal sloping of the drain pan 55. An upward sloping bank 53 will retain a portion of the water in the V-pocket 52 so that some of the water will always touch the lower portion of a downwardly extending wedge 54 thereby preventing the outside atmosphere from reaching the air conditioned area through the hazardous duty air conditioner 15. The water collected on the evaporator coils 20, which flows to the rear of the Hazardous Duty Air Conditioner 15, is evaporated on the hot condenser coil 17 by means of a slinger. The slinger, which is operated by the fan motor 19, is of the traditional type which picks up the collected water and slings it onto the hot condenser coil 17. This is a method commonly used in the industry to dispose of the collected water without allowing it to drip outside of the air conditioned room.

The present invention is designed for use in equipment rooms at remote locations that may be left unoccupied for long periods of time. Therefore, a means to prevent frost collection on the evaporator coils and subsequent freeze-up of the unit is needed. Otherwise, upon freeze-up of the air conditioning unit, the room temperature would rise and possibly destroy much of the equipment contained therein. A bypass valve 23 connects the output of compressor 16 to the input, with the bypass valve being normally closed under most operating conditions. If the suction pressure of the compressor 16 is within the normal operating range of 70 to 80 pounds, the bypass valve 23 is cut off and nothing can flow therethrough. However, if the suction pressure within the compressor 16 drops below a predetermined point, for example 55 pounds, the bypass valve 23 will cut on allowing flow of the high pressurized gas from the output side of the compressor 16 to flow to the input side. This drop in the suction pressure of the compressor 17 is caused by an excess accumulation of frost or ice on the evaporator 20, which prevents the proper transfer of heat from the atmosphere to the evaporator coils. The bypass valve 23 is spring loaded to remain open until the suction pressure has returned to a normal operating level. By bypassing the pressurized vapor from the output of the compressor 17 back to the input, the evaporator 20 will return to ambient room temperature causing any frost or ice collected thereon to melt.

Figure 9:
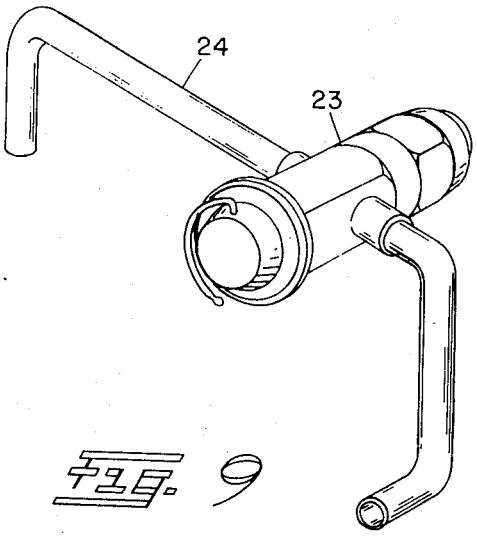
FIG. 9 is an isolated pictorial view of the bypass valve shown in FIGS. 1 and 2.

A better view of the bypass valve 23 is shown in FIG. 9 as it is connected to the conduit 24 that connects the output to the input of the compressor 17.

As has been mentioned before, the present invention was designed initially for use to cool equipment rooms in offshore drilling platforms that may be left unoccupied over extended periods of time. Because of the environment and the hazardous working conditions, an air conditioner used under these circumstances must meet special requirements. These requirements are published by the National Fire Protection Association International, NFPA No. 70–68, Vol. 5, Art. 500, in Boston, Massachusetts. This publication sets out the guidelines that must be met for electrically safe circuits. The air conditioner described in this invention will meet Underwriter Laboratories Inc. requirements for Class 1, Division 2, Group D hazardous location, which is the classification within which an offshore drilling platform would fall. A definition of Class 1, Division 2 is a location in which volatile, flammable liquids or flammable gases are handled, processed or used, but in which hazardous liquids, vapors or gases will normally be confined within closed containers or closed systems from which they can escape only in case of accidental rupture or breakdown of such containers or systems or in case of abnormal operation of the equipment. A definition of Division 2 equipment is equipment in which normal operation would not ignite a specific hazardous atmosphere in its most easily ignited concentration. Group D is the specific hazardous gas vapor or liquid present in the Class 1, Division 2 location.

Figure 12:
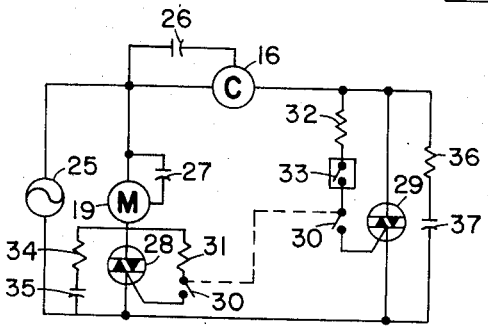
FIG. 12 is the electrical schematic of the air conditioner shown in FIGS. 1 and 2.

Before finishing the discussion on FIGS. 1 and 2 of the drawings, refer now to FIG. 12, which shows the schematic diagram of the control circuit for the Hazardous Duty Air Conditioner 15. The power source 25 is of a normal type of AC line voltage at approximately 230 volts. It should be realized that other types of power can be used and transformed to the desired condition for use. The power source 25 connects directly to the compressor 16 and the shunt or run capacitor 26. Also, the line voltage is connected to fan motor 19 and its shunt or run capacitor 27. The fan motor 19 is connected to the opposite side of the power source 25 by means of triac 28. The compressor 16 is connected to the opposite side of the power source 25 by means of triac 29. The gate of the triacs 28 and 29 are controlled by a double pole, single throw switch 30. The switch 30, which is the ON/OFF switch for the Hazardous Duty Air Conditioner 15, has resistors 31 and 32 in series with the gates of triacs 28 and 29, respectively, to limit the current flow. In series with resistor 32 and the side of switch 30 connected to the gate of triac 29 is a thermostat 33 that closes if the room temperature is above a predetermined level.

Assuming that the temperature in the room is above the predetermined level so that the thermostat 33 is closed and the switch 30 is then closed, a small current will begin to flow in the gate of triac 29. This small current will cause the triac to begin conducting, thereby connecting the compressor 16 across the power source 25. The amount of current that flows through the switch 30 to trigger the gates of triacs 28 and 29, is very low; hence, any arcing that may take place inside the switch 30 will be of a very low heat intensity. Resistor 34 and capacitor 35 prevent the false triggering of triac 28, while resistor 36 and compacitor 37 prevent a false triggering of triac 29.

Figure 8:
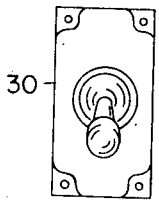
FIG. 8 is a front view of the switch shown in FIG. 1.
Figure 7:
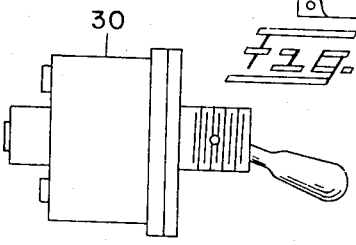
FIG. 7 is a side view of the switch shown in FIG. 1.

The double pole, single throw switch 30 is shown in more detail in FIGS. 7 and 8. The switch 30 is environmentally sealed so that if any explosive gas or vapor seeped into the switch 30, any explosion resulting from the turning of the switch 30 ON or OFF will be contained within the switch 30 itself.

The thermostat 33 has gold plated contacts to prevent corrosion due to the salt water atmosphere, thereby keeping resistance very low. Because of the very low current that will be flowing through thermostat 33 and switch 30 in series therewith, no arc generated is of sufficient intensity and duration to ignite Class 1, Division 2, Group D atmospheric conditions in their most concentrated form.

Referring back to FIGS. 1 and 2, elements just mentioned in conjunction with FIG. 12 can be seen. Because of the current flow through triac 29, a heat sink 38 is necessary to maintain the temperature of the triac 29 within a normal operating range. The current flow in triac 29 under normal operation does not exceed twelve amps; however, transient conditions could push the load current to 50 amps. A triac rated for approximately forty amps will operate in the circuit with the heat sink 38 to dissipate the radiated energy and will handle any current that may pass through compressor 16. Compressor 16 has an internal overload that will break the power connection across the compressor 16 if a lock condition exceeds more than approximately 12 to 15 seconds. The overload for compressor 16 is a bimetal operated switch that is contained internally within the compressor 16. However, any arc that may result from the overload switch in compressor 16 will not reach the atmosphere because the compressor 16 is a sealed unit with the overload switch being contained therein. Fan motor 19 also has an overload switch contained within the fan motor to open if a locked fan condition exists more than a predetermined amount of time with power applied. Again the overload switch is bimetal operated within the fan motor 19 and sealed to prevent explosions due to gases in the atmosphere. The overload for fan motor 19 is double potted to insure a good seal and preventing possible explosions.

Figure 4:
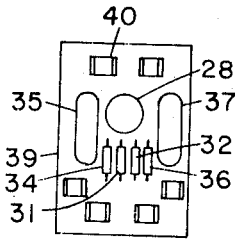
FIG. 4 is a front view of the printed circuit board visible in FIG. 1.
Figure 5:
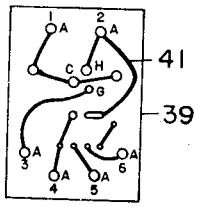
FIG. 5 is a back view of the printed circuit board visible in FIG. 1 and shown in FIG. 4.

The small electrical components shown in FIG. 12 are mounted on a terminal board 39 which is mounted as shown in FIG. 1. The terminal board can be seen in more detail in FIGS. 4 and 5, with the components mounted thereon. The terminal board 39, which was designed especially for the Hazardous Duty Air Conditioner 15, has quick disconnect terminals 40 for easy connection. The rear of the terminal board 39, as shown in FIG. 5, shows the connection between the various electrical elements by means of conducting strips 41.

Figure 6:
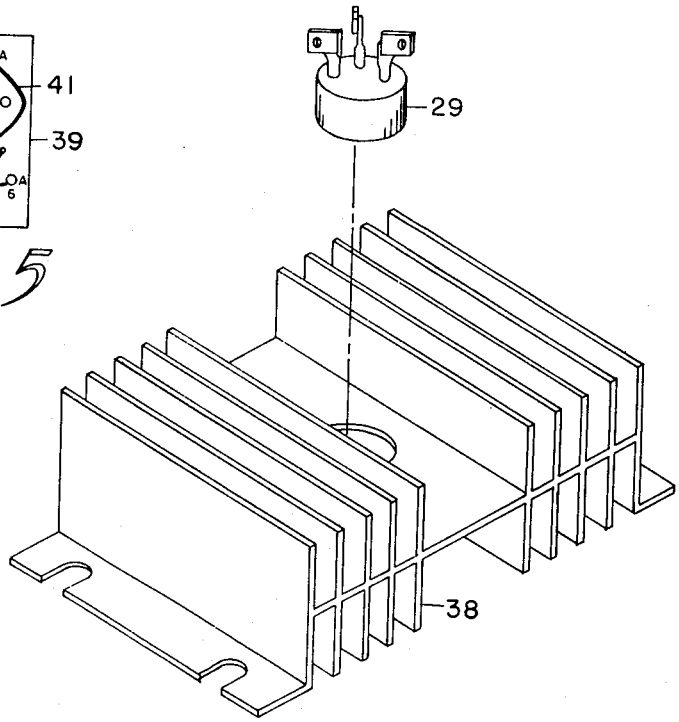
FIG. 6 is an exploded pictorial view of the triac and heat sink visible in the cutaway section of FIG. 1.
Figure 10:
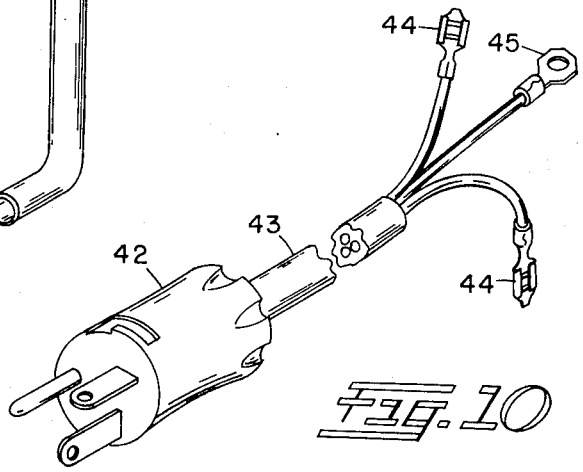
FIG. 10 is an isolated pictorial view of the power cord and connector shown in FIG. 1.
Figure 11:
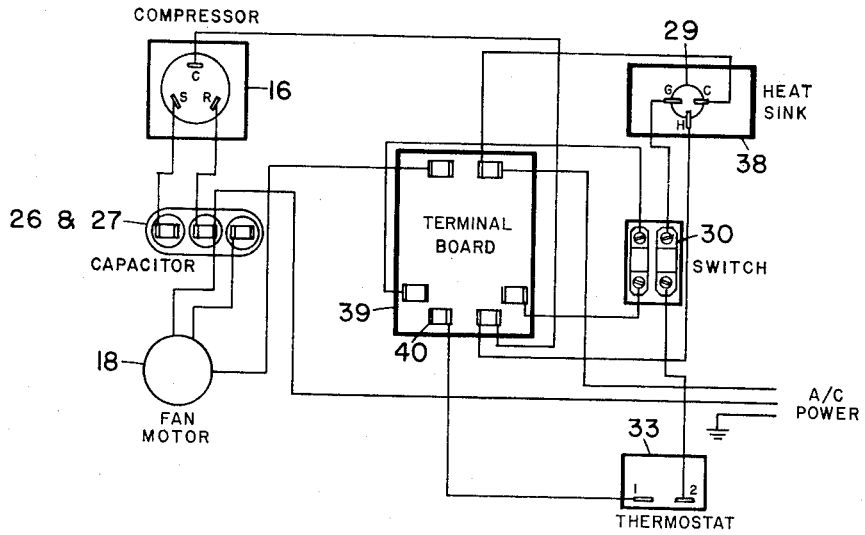
FIG. 11 is the wiring diagram of the air conditioner shown in FIGS. 1 and 2.

A pictorial wiring diagram for the Hazardous Duty Air Conditioner 15 is shown in FIG. 11 with the numerals designating the like parts. Notice the capacitors 26 and 27 are contained within a common case and have a common connection. The assembly of the triac 69 to the heat sink 38 is shown in more detail in FIG. 6. Referring to FIG. 10, the power connection is through plug 42 and cord 43 with the plug and cord being of an explosive proof type to prevent arcing upon connection and disconnection of the Hazardous Duty Air Conditioner 15. The cord 43 has quick connect terminals 44 and ground terminals 45 attached.

In the preferred embodiment, the electrical components may be as given in the following table with the numbers representing the components. However, it should be realized that other components may be used and still be within the scope and the purpose of the present invention.

TABLE I

| | |
|---|---|
| 16 | Copeland Compressor RRL4-0175-PFV |
| 18 | Emerson Fan Motor K 55 HXJHJ-5215 |
| 26 | Run Capacitor 600-803-66 |
| 27 | Run Capacitor 600-803-66 |
| 28 | E.C.C. Quadrac Q5006 |
| 29 | E.C.C. Quadrac Q5040PF |
| 30 | Cutler-Hammer DPST8521K9 |
| 31 | 470 Ohm ½ Watt 10% |
| 32 | 470 Ohm ½ Watt 10% |
| 33 | Ranco Thermostat A30-6501 |
| 34 | 100 Ohm ½ Watt 10% |
| 35 | 0.1 MFD 400 Volt |
| 36 | 100 Ohm ½ Watt 10% |
| 37 | 0.1 MFD 400 Volt |
| 42 | Appleton Plug ECP 20232 |
| 43 | SO Heavy Duty Supply Cord |

Figure 13:
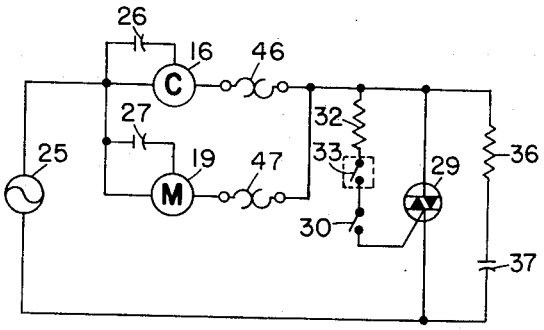
FIG. 13 is an alternative design for the electrical schematic shown in FIG. 12.

Referring now to FIG. 13 of the drawings, there is shown an alternative schematic for the Hazardous Duty Air Conditioner wherein only one triac is required. In this schematic, like components will be given like numerals as in FIG. 12. The power source 25 is connected to the compressor motor 16 and run capacitor 26, which is connected in parallel with fan motor 19 and run capacitor 27. The compressor 16 should be rated for 2,400 watts at 230 volts with a full load amperage of 11.8 amps and a locked rotor amperage of 50 amps. Also, compressor 16 has an overload switch 46 connected in series with the windings of the compressor 16. The overload switch 46 is contained within the sealed unit of the compressor 16 so that explosive gases or vapors cannot get to the overload switch 46. Likewise, fan motor 19 has an overload switch 47 connected in series therewith and again sealed within the motor unit 19. The overload switches 46 and 47 would prevent a burn-out of the compressor 16 or fan motor 19, respectively, and consequently prevent any explosion that may result thereby. The fan motor 19 should be rated for 414 watts at 230 volts with a full load amperage of 1.8 amps and a locked rotor amperage of 3.2 amps.

The compressor 16 and the fan motor 19 are connected in parallel, with the entire load of both being carried by the series triac 29. The triac 29 is controlled in its gate circuit by thermostat 33 and power switch 30 in a manner as previously described in conjunction with FIG. 12. If the temperature inside the room exceeds a predetermined point, the thermostat 33 will close so that upon closing the power switch 30 current will flow through current limiting resistor 32 to the gate of triac 29. Current flowing in the gate of triac 29 will cause the triac 29 to turn on, thereby connecting the compressor 16 and fan motor 19 across the power source 25. Resistor 36 and capacitor 37 again prevent a false turn-on of the triac 29 and allow for a bypass for the transient conditions of an inductive load. The thermostat 33 could be a magnetically operated Reed switch provided it has low contact resistance.

A triac that carries the compressor current should be rated for approximately forty amps and can expect a transient turn-on current of approximately 50 amps. By having an overload switch in the compressor 16, the overload switch will open after approximately 15 seconds, thereby stopping the current flow through triac 29 and preventing damage due to overheating.

The Hazardous Duty Air Conditioner 15 has been tested with ambient conditions, both inside and outside of the air conditioner, being 104° Fahrenheit. Another series of tests was conducted with the indoor temperature being 60 degrees Fahrenheit, with the outdoor ambient temperature being 45° Fahrenheit. In both cases the Hazardous Duty Air Conditioner 15 operated over continuous periods of time without failure, explosion or freeze-up in a Class 1, Division 2, Group D type of atmosphere as required for Underwriters Laboratories Inc. safety standards UL 698 and UL 913 as applicable to Class 1, Division 2, Group D equipment.

Since the most logical use for the present invention is in offshore drilling platforms, the Hazardous Duty Air Conditioner 15 should meet the rugged requirements for a salt water atmosphere. To meet these rugged requirements, the normal shaft of fan motor 19 was replaced with a stainless steel shaft to prevent corrosion and motor lock-up. Also, the evaporator 20 and the condenser 17 have been treated to prevent corrosion due to salt water atmosphere. The treatment consists of dipping both the condenser 17 and evaporator 20 in a solution of Alodine, which is the trade name of a solution sold by American Chemical Company. Alodine, which forms a thin layer over the condenser 17 and evaporator 20, protects against the rugged atmospheric conditions on an offshore drilling rig.

Even though the present invention was described in conjunction with oil drilling operations in offshore platforms, it should be understood that the present Hazardous Duty Air Conditioner 15 has many other applications where a hostile environment is involved. Though designed specifically for this particular type of atmospheric condition, little or no modification may be required in the Hazardous Duty Air Conditioner 15 to make it suitable for other locations such as mining operations, chemical processing or numerous other industrial uses.

What is claimed is:

1. A control circuit for an air conditioner for use in hostile environments, comprising:

a compressor motor having a first internal overload circuit;

a fan motor having a second internal overload circuit;

a pair of triacs each having a respective low current triggering means, one of said triacs being connected in circuit with said compressor motor and the other of said triacs being connected in circuit with said fan motor;

thermostat means for controlling the triggering means of said one triac to prevent operation of said compressor motor when room temperature is below a predetermined level;

manual double pole, double throw switch means for controlling the application of power to said air conditioner by simultaneously connecting said triggering means of both said triacs to a power source.

2. The circuit of claim 1, wherein said thermostat means includes a first switch which opens below a predetermined temperature, said manual switch means includes second and third ganged switches, said triggering means of said one triac including a first low current source and a trigger lead connected to said first low current source via said first and second switches in series, and said triggering means of said other triac including a second low current source and a trigger lead connected to said second low current source via said third switch.

* * * * *